US008164411B2

(12) United States Patent
Cheng et al.

(10) Patent No.: US 8,164,411 B2
(45) Date of Patent: Apr. 24, 2012

(54) FUSE STRUCTURE WITH POWER DISCONNECTION LIGHT INDICATING FUNCTION

(76) Inventors: Wen-Tsung Cheng, Taoyuan County (TW); Wen-Ho Cheng, Taoyuan County (TW)

( * ) Notice: Subject to any disclaimer, the term of this patent is extended or adjusted under 35 U.S.C. 154(b) by 246 days.

(21) Appl. No.: 12/652,961

(22) Filed: Jan. 6, 2010

(65) Prior Publication Data

US 2011/0163839 A1 Jul. 7, 2011

(51) Int. Cl.
*H01H 85/32* (2006.01)

(52) U.S. Cl. ..... 337/266; 337/198; 337/241; 337/242; 337/265

(58) Field of Classification Search ..... 337/198, 337/241, 242, 265, 266
See application file for complete search history.

(56) References Cited

U.S. PATENT DOCUMENTS

| | | | | | |
|---|---|---|---|---|---|
| 3,588,775 | A | * | 6/1971 | Poehlman, Jr. | 337/226 |
| 4,224,592 | A | * | 9/1980 | Urani et al. | 337/198 |
| 4,281,322 | A | * | 7/1981 | Nasu et al. | 340/638 |
| 4,308,516 | A | * | 12/1981 | Shimada et al. | 337/241 |
| 4,391,485 | A | * | 7/1983 | Urani | 439/687 |
| 4,475,283 | A | * | 10/1984 | Olson et al. | 29/720 |
| 4,499,447 | A | * | 2/1985 | Greenberg | 337/266 |
| 4,661,807 | A | * | 4/1987 | Panaro | 340/638 |
| 4,695,815 | A | * | 9/1987 | Hwang | 337/266 |
| 4,712,081 | A | * | 12/1987 | Bosley | 337/266 |
| 4,772,219 | A | * | 9/1988 | Falchetti | 439/490 |
| 4,815,993 | A | * | 3/1989 | Falchetti | 439/620.33 |
| 4,941,851 | A | * | 7/1990 | Hsueh | 439/620.34 |
| 4,997,394 | A | * | 3/1991 | Katz et al. | 439/620.33 |
| 5,002,505 | A | * | 3/1991 | Jones et al. | 439/620.29 |
| 5,004,995 | A | * | 4/1991 | Lo | 337/266 |
| 5,055,071 | A | * | 10/1991 | Carlson et al. | 439/620.34 |
| 5,311,139 | A | * | 5/1994 | Fogal | 324/550 |
| 5,598,138 | A | * | 1/1997 | Jaronczyk, Jr. | 337/265 |
| 5,701,118 | A | * | 12/1997 | Hull et al. | 340/638 |
| 5,818,320 | A | * | 10/1998 | Matsuoka | 337/198 |
| 5,874,884 | A | * | 2/1999 | Hull et al. | 337/241 |
| 6,054,915 | A | * | 4/2000 | Rowton et al. | 337/216 |
| 6,144,284 | A | * | 11/2000 | Santa Cruz et al. | 337/242 |
| 6,157,287 | A | * | 12/2000 | Douglass et al. | 337/198 |
| 6,373,370 | B1 | * | 4/2002 | Darr et al. | 337/243 |
| 6,448,897 | B1 | * | 9/2002 | Ku | 340/638 |
| 6,542,061 | B2 | * | 4/2003 | Santa Cruz et al. | 337/79 |
| 6,587,028 | B2 | * | 7/2003 | Mollet et al. | 337/194 |

(Continued)

FOREIGN PATENT DOCUMENTS

| | | |
|---|---|---|
| TW | M302769 | 12/2006 |

(Continued)

*Primary Examiner* — Anatoly Vortman
(74) *Attorney, Agent, or Firm* — Chun-Ming Shih; HDLS IPR Services

(57) ABSTRACT

A fuse structure includes a casing, a fuse component and a light emitting element having pins. The casing includes a top plate, a containing space disposed below the top plate and two openings formed on the top plate. The fuse component includes two electrically conductive plates and a fuse filament, and each electrically conductive plate has a conducting portion protruded from an upper end of the electrically conductive plate, and the conducting portions are inserted into the two openings respectively. The top plate includes two compressing portions protruded from the bottom of the top plate and arranged alternately with the two conducting portions, such that an interval is formed between an external edge of each compressing portion and an internal edge of each corresponding conducting portion, and the pins of the light emitting element are clamped in the interval.

8 Claims, 5 Drawing Sheets

U.S. PATENT DOCUMENTS

| | | | | |
|---|---|---|---|---|
| 6,775,148 | B2 * | 8/2004 | Hong | 361/752 |
| 6,836,206 | B2 * | 12/2004 | Lee | 337/243 |
| 7,049,973 | B2 * | 5/2006 | Torrez et al. | 340/638 |
| 7,126,488 | B1 * | 10/2006 | May | 340/638 |
| 7,339,486 | B2 * | 3/2008 | Huang | 340/638 |
| 7,385,518 | B2 * | 6/2008 | Torrez et al. | 340/638 |
| 7,394,343 | B2 * | 7/2008 | Cheng et al. | 337/265 |
| 7,460,004 | B1 * | 12/2008 | Yang | 337/206 |
| 7,570,147 | B2 * | 8/2009 | Muller | 337/206 |
| 7,675,087 | B1 * | 3/2010 | Cheng et al. | 257/99 |
| 7,772,959 | B2 * | 8/2010 | Cheng et al. | 337/242 |
| 2003/0179070 | A1 * | 9/2003 | Izumi | 337/255 |
| 2004/0017203 | A1 * | 1/2004 | Becker et al. | 324/507 |
| 2005/0035842 | A1 * | 2/2005 | Shyu | 337/265 |
| 2005/0206492 | A1 * | 9/2005 | Chao | 337/198 |
| 2006/0017540 | A1 * | 1/2006 | Smith | 337/242 |
| 2007/0109090 | A1 * | 5/2007 | Cheng et al. | 337/123 |
| 2010/0019878 | A1 * | 1/2010 | Darr et al. | 337/198 |
| 2010/0033292 | A1 * | 2/2010 | Cheng et al. | 337/241 |
| 2010/0033293 | A1 * | 2/2010 | Cheng et al. | 337/241 |
| 2010/0133552 | A1 * | 6/2010 | Cheng et al. | 257/88 |

FOREIGN PATENT DOCUMENTS

| | | |
|---|---|---|
| TW | M321525 | 11/2007 |

* cited by examiner

FUSE STRUCTURE WITH POWER DISCONNECTION LIGHT INDICATING FUNCTION

BACKGROUND OF THE INVENTION

1. Field of the Invention

The present invention relates to a fuse, and more particularly to a fuse assembly with a power disconnection light indicating function.

2. Description of Prior Art

Fuse is an over-current protection device generally used in an electric appliance or a circuit, and a fuse filament of the fuse melts or the fuse blows to prevent over-current from damaging electronic components installed in the electric appliance, since current will be increased if the electric appliance breaks down or the circuit fails to operate normally, and the current passed through the electric appliance or circuit will exceed a loading limit of the fuse. Therefore, the fuse can achieve the effects of protecting electric appliances and maintaining or repairing circuits.

In general, a light emitting element is installed in the fuse to facilitate maintenance and repair and indicate a damaged fuse. As disclosed in Taiwan Patent. Nos. 302769 and 321525 entitled "Safety power-disconnection terminal device having a light indication" and "Fuse device having a power disconnection warning effect" respectively, a dipole light emitting diode processed by a SMD packaging process is provided for achieving the light indication or warning effect. However, the light emitting diode is electrically connected to a metal plate in the fuse, and it is difficult to assure a proper contact, and thus the electrical conductivity effect and the yield rate of the product may be affected adversely.

SUMMARY OF THE INVENTION

Therefore, it is a primary objective of the present invention to provide an improved fuse structure with a power disconnection light emitting function, wherein a light emitting element is installed in a casing of a fuse by a one-time manufacturing process during the process of assembling the fuse, such that the light emitting element can have a better contact area with a fuse component in the fuse to achieve a better electrical conductivity effect and improve the yield rate of the product.

To achieve the foregoing objective, the present invention provides an improved fuse structure with a power disconnection light emitting function, and the fuse structure comprises a casing, a fuse component, and a light emitting element having anode and cathode pins. The casing includes a top plate, a containing space disposed below the top plate and two openings formed on the top plate and interconnected to the containing space. The fuse component is installed in the containing space and includes two electrically conductive plates and a fuse filament, and each electrically conductive plate has a conducting portion protruded from an upper end of the electrically conductive plate, and each conducting portion has a concave forked opening such that each conducting portion is fork-shaped and has two forked horns, and the forked horns of the conducting portions are inserted into the two openings respectively. The top plate includes two compressing portions protruded from the bottom of the top plate and arranged alternately with the two conducting portions, such that an interval is formed between an external edge of each compressing portion and an internal edge of each corresponding conducting portion, and the pins of the light emitting element are clamped in the interval.

DETAILED DESCRIPTION OF THE INVENTION

The technical characteristics, features and advantages of the present invention will become apparent in the following detailed description of the preferred embodiments with reference to the accompanying drawings. The drawings are provided for reference and illustration only, but not intended for limiting the present invention.

Figure 1:
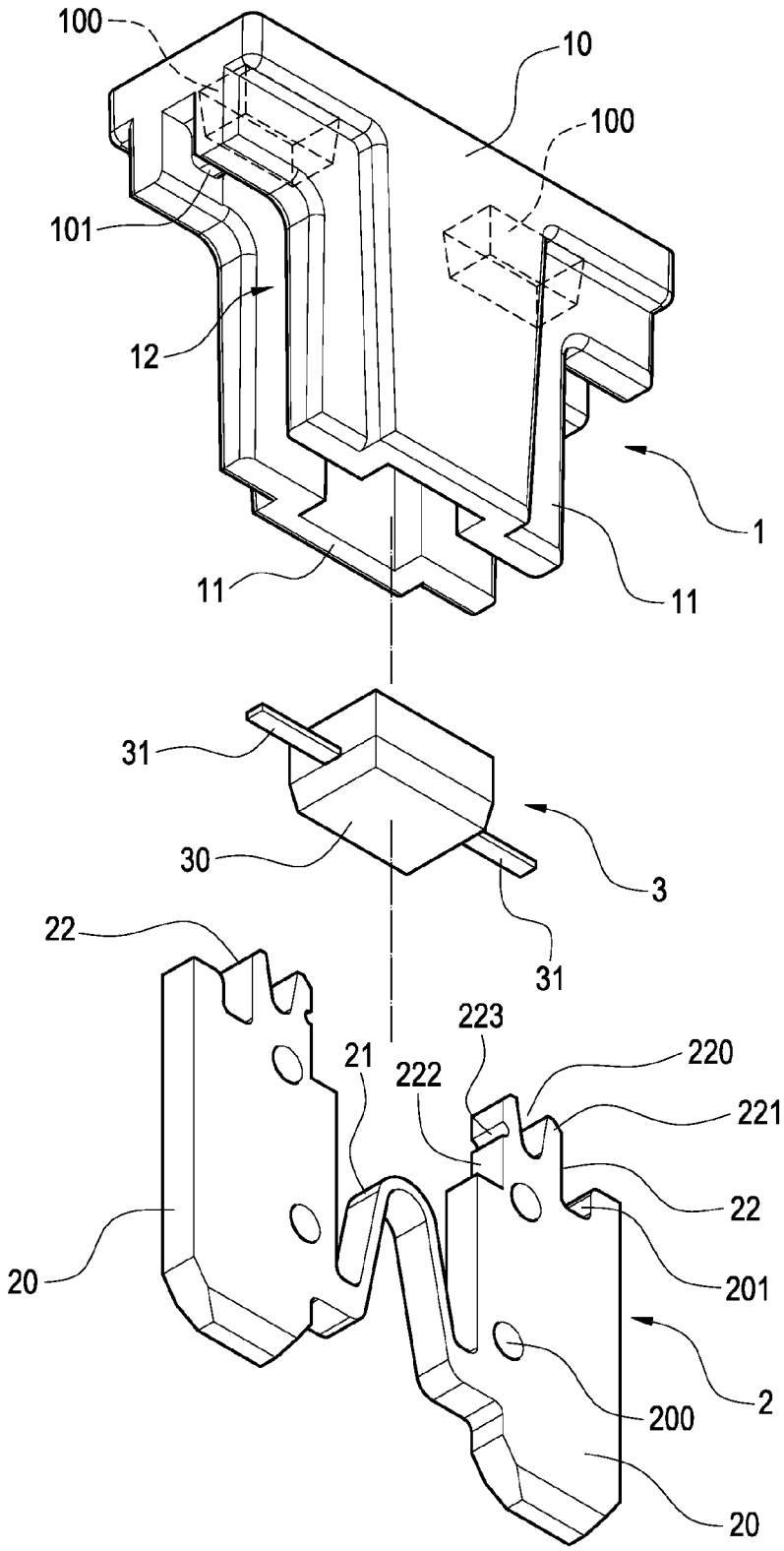
FIG. 1 is an exploded view of the present invention.
Figure 2:
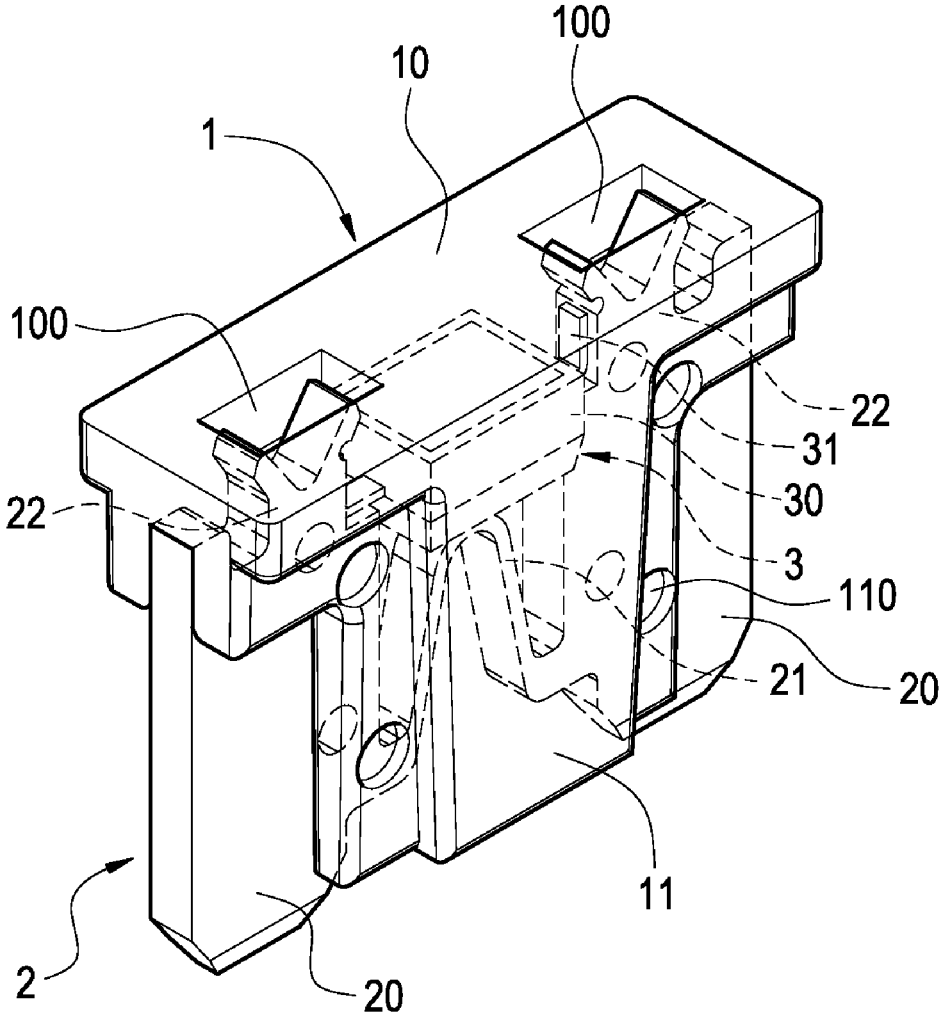
FIG. 2 is a perspective view of the present invention.

With reference to FIGS. 1 and 2 for an exploded view and a perspective view of the present invention respectively, an improved fuse structure with a power disconnection light emitting function of the present invention comprises a casing 1, a fuse component 2, and a light emitting element 3.

The casing 1 is made of an insulating material, and the casing 1 includes a top plate 10, and two side plates 11 disposed with an interval apart and opposite to each other and extended out from the bottom of the top plate 10, and a containing space 12 is formed between two side plates 11, and two openings 100 are arranged linearly on the top plate 10 of the casing 1 and interconnected to the containing space 12 for inserting the fuse component 2. The casing 1 is further made of a translucent material, or only the middle position of the top plate 10 opposite to the light emitting element 3 is made of a translucent material.

The fuse component 2 is made of an electrically conductive material, and the fuse component 2 includes two electrically conductive plates 20 and a fuse filament 21 coupled between the two electrically conductive plates 20, and each electrically conductive plate 20 has a conducting portion 22 protruded from an upper end of the electrically conductive plate 20, and a forked opening 220 concavely formed at a distal end of the conducting portion 22, such that the distal end of the conducting portion 22 is fork-shaped and includes two forked horns 221, and the forked horns 221 of each of the two conducting portions 22 are inserted into the two openings 100 of the top plate 10 of the casing 1.

The light emitting element 3 can be a light emitting diode, and includes a light source portion 30, and anode and cathode pins 31 are extended from the light source portion 30, and the light source portion 30 is disposed below the middle of the top plate 10 of the casing 1, and the two pins 31 are clamped between the casing 1 and the fuse component 2. When the light emitting element 3 is connected to the casing 1 and the fuse component 2 of the present invention, the fuse component 2 can be used for pushing the light emitting element 3 into the containing space 12 of the casing 1, such that the two pins 31 of the light emitting element 3 can be clamped tightly between the casing 1 and the fuse component 2 by a one-time manufacturing process, and the contact area between the two pins 31 and the fuse component 2 can be increased to achieve a better electrical conductivity effect and improve the yield rate of the product.

Figure 3:
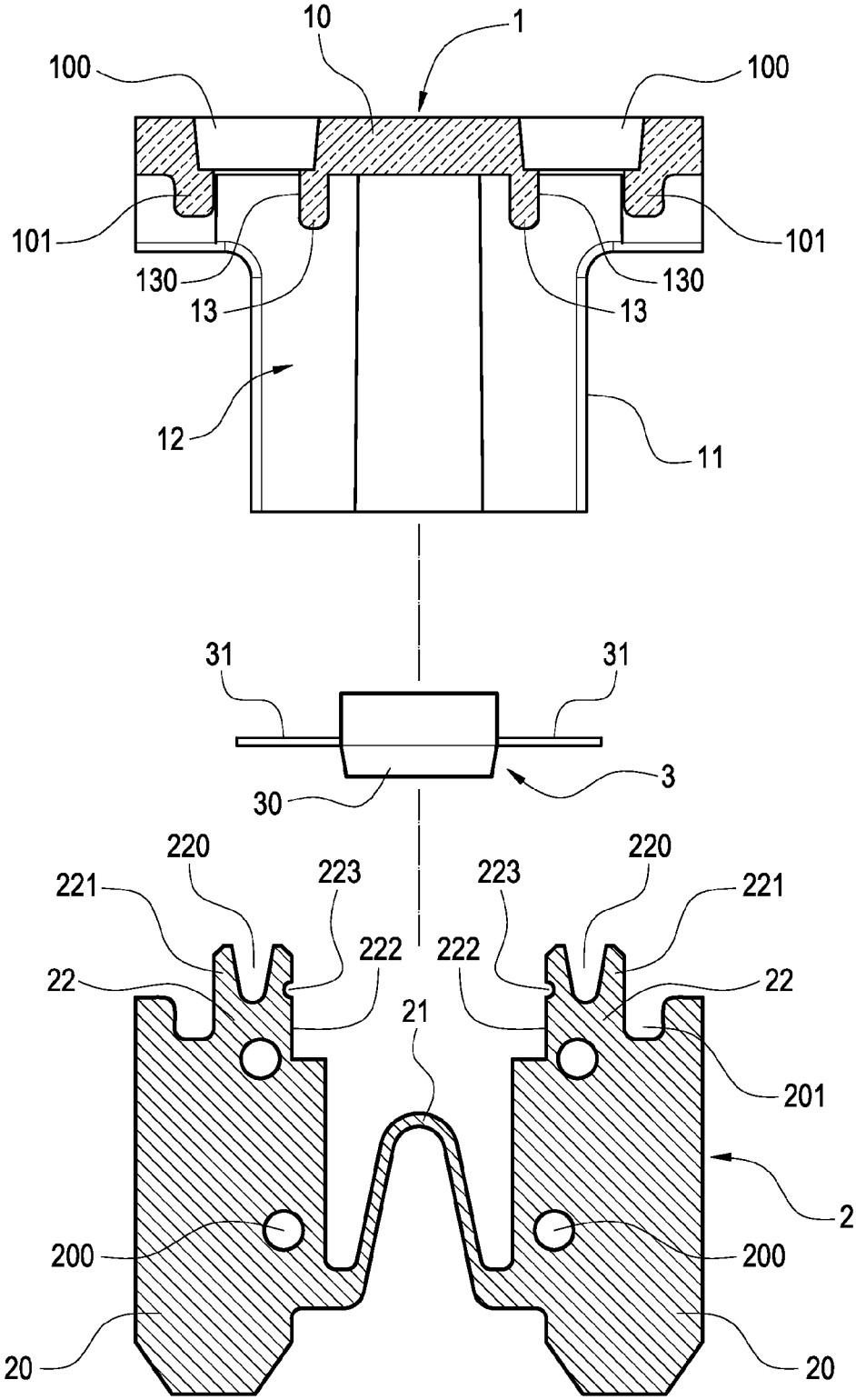
FIG. 3 is a planar exploded view of an internal structure of the present invention.
Figure 4:
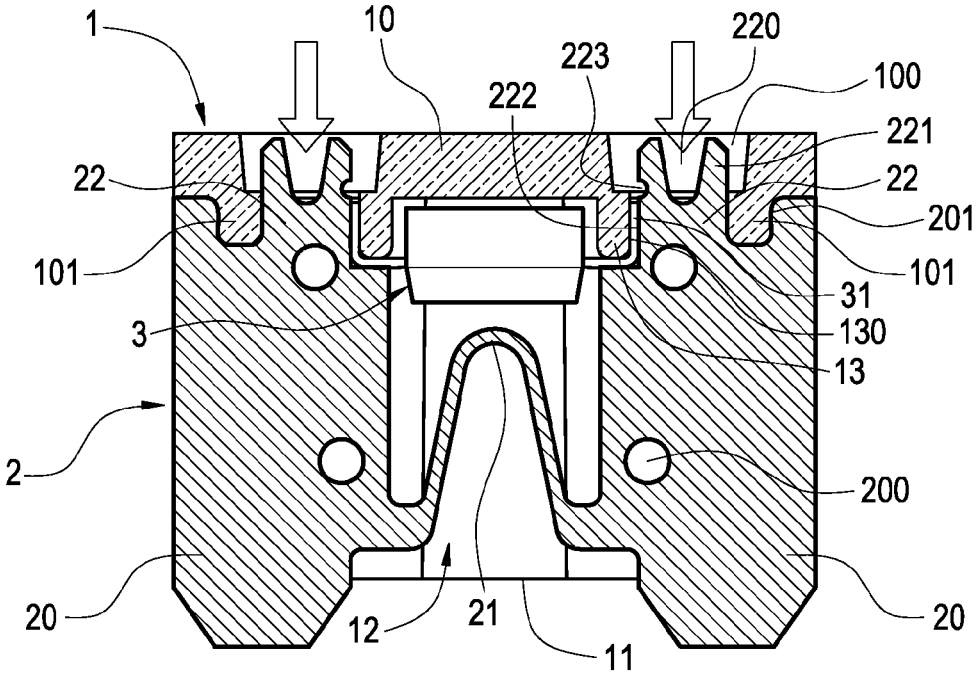
FIG. 4 is a schematic view of operating movements of an internal structure of the present invention.
Figure 5:
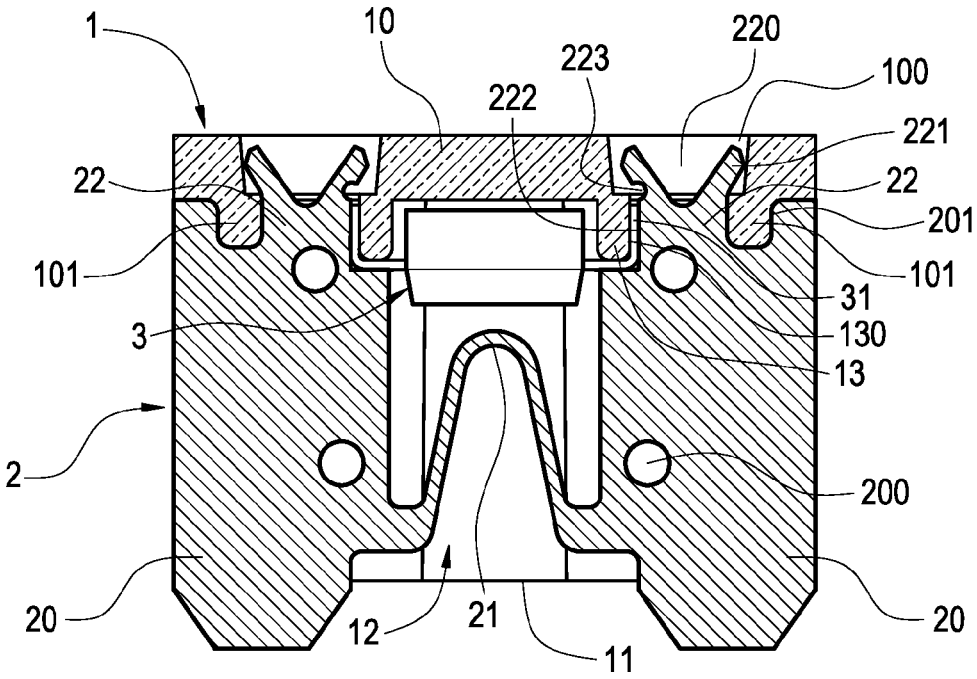
FIG. 5 is a planar view of an assembled internal structure of the present invention.

With reference to FIG. 3, two compressing portions 13 are protruded from the bottom of the top plate 10 of the casing 1 and extended into the containing space 12, wherein the two compressing portions 13 are disposed alternately with the two conducting portions 22, such that an interval is formed between an external edge 130 of the compressing portion 13 and an internal edge 222 of the conducting portion 22, wherein the interval is substantially equal to the thickness of the pin 31 of the light emitting element 3. In FIG. 4, after the fuse component 2 is inserted into the containing space 12 of the casing 1, the two conducting portions 22 are used for pressing the two pins 31 of the light emitting element 3 according to the deformations at the internal edge 222 of the conducting portion 22 and the external edge 130 of the compressing portion 13 and clamped between the casing 1 and the fuse component 2. In the preferred embodiment of the present invention, the two pins 31 are substantially L-shaped to match deformations occurred at the internal edge 222 of the conducting portion 22 and the external edge 130 of the compressing portion 13. In FIG. 5, after the forked horns 221 of the two conducting portions 22 are inserted into the two openings 100 of the top plate 10, the forked opening 220 is spread open, such that the maximum width of the forked horn 221 is greater than the width of the opening 100, and the fuse component 2 can be latched securely into the containing space 12 of the casing 1 to assure a good contact of the two pins 31 of the light emitting element 3 with the fuse component 2, so as to achieve a good electrical conductivity effect.

It is noteworthy to point out that a notch 223 is concavely and separately formed on the external edges of the forked horns 221 of the two conducting portions 22 and proximate to the two pins 31 of the light emitting element 3, and the notch 223 is provided for assuring the fuse component 2 to be latched to edges of the opening 100 to prevent the fuse component 2 from falling off, if the fuse component 2 is loosened from the casing 1. In addition, the casing 1 includes a first position aligning portion 101 protruded downwardly and separately from both sides of the top plate 10, and a second position aligning portion 201 concavely formed at a corresponding position of the fuse component 2, such that the first and second position aligning portions 101, 201 can be used for aligning the casing 1 with the fuse component 2 for a more precise engagement to prevent them from being loosened easily.

Figure 6:
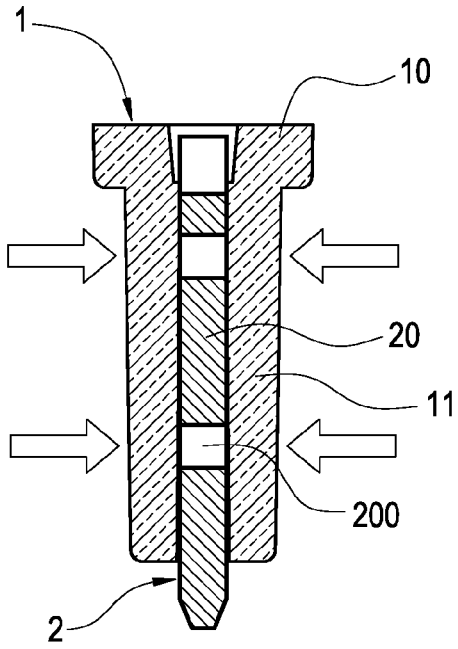
FIG. 6 is a schematic view of operating movements of an internal structure of the present invention viewed from another viewing angle.
Figure 7:
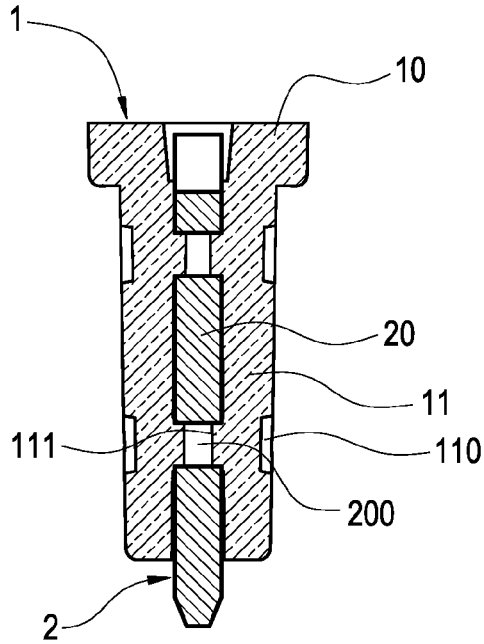
FIG. 7 is a planar view of an assembled internal structure of the present invention viewed from another viewing angle.

In FIGS. 6 and 7, the two electrically conductive plates 20 of the fuse component 2 have a plurality of positioning holes 200 for facilitating a process of stamping corresponding positions of the two side plates 11 of the casing 1 to form recesses 110 at corresponding positions on external surfaces of the two side plates 11 and protrusions 111 on internal surfaces and extended into the positioning holes 200 respectively, such that the casing 1 and the fuse component 2 can be connected more securely.

With the aforementioned structure, an improved fuse structure with a power disconnection light emitting function of the present invention is achieved.

In summation of the description above, the present invention improves over the prior art and complies with patent application requirements, and thus is duly filed for the patent application.

The present invention is illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A fuse structure with a power disconnection light emitting function, comprising:

a casing, having a top plate, a containing space disposed below the top plate, and two openings formed in the top plate and interconnected to the containing space;

a fuse component, installed in the containing space, and including two electrically conductive plates, and a fuse filament coupled between the two electrically conductive plates, and each electrically conductive plate having a conducting portion protruded from an upper end of the electrically conductive plate, and each conducting portion having a concave forked opening formed thereon, such that each conducting portion is fork-shaped and has two forked horns, and the two conducting portions are inserted into the two openings respectively; and a light emitting element disposed inside the containing space, having two anode and cathode pins;

wherein two compressing portions are protruded from the bottom of the top plate and extended into the containing space, and the two compressing portions are disposed adjacent to the two conducting portions respectively, such that an interval is formed between each compressing portion and a corresponding conducting portion, and each pin of the light emitting element are clamped in the interval, and wherein the casing further has a first position aligning portion protruded from the bottom of the top plate and extended into the containing space, the fuse component further has a second position aligning portion concaved on the upper end of one electrically conductive plate, and the first and the second position aligning portions are aligned in positions corresponding to each other.

2. The fuse structure with a power disconnection light emitting function as recited in claim 1, wherein the casing is made of a translucent material.

3. The fuse structure with a power disconnection light emitting function as recited in claim 1, wherein only the middle of the casing disposed at a position corresponding to the light emitting element is made of a translucent material.

4. The fuse structure with a power disconnection light emitting function as recited in claim 1, wherein the casing further includes two side plates extended from the bottom of the top plate, and the containing space is formed between the two side plates.

5. The fuse structure with a power disconnection light emitting function as recited in claim 4, wherein the two electrically conductive plates of the fuse component include a plurality of positioning holes, a plurality of recesses are formed at corresponding positions on external surfaces of the two side plates, and a plurality of protrusions formed on internal surfaces of the two side plates and extended into the positioning holes respectively.

6. The fuse structure with a power disconnection light emitting function as recited in claim 1, wherein each conducting portion has a concave notch formed on one forked horn adjacent to a bottom edge of the opening.

7. The fuse structure with a power disconnection light emitting function as recited in claim 1, wherein the light emitting element is a light emitting diode.

8. The fuse structure with a power disconnection light emitting function as recited in claim 1, wherein each pin of the light emitting element is deformed in the interval to form an L-shape.

* * * * *